US010145614B2

(12) United States Patent
Yang et al.

(10) Patent No.: US 10,145,614 B2
(45) Date of Patent: Dec. 4, 2018

(54) FURNACE DOOR SEALING DEVICE FOR LOW-PRESSURE DIFFUSION FURNACE

(71) Applicant: S.C New Energy Technology Corporation, Shenzhen, Guangdong Province (CN)

(72) Inventors: Baoli Yang, Shenzhen (CN); Yong Zhang, Shenzhen (CN)

(73) Assignee: S.C NEW ENERGY TECHNOLOGY CORPORATION, Shenzhen, Guangdong Province (CN)

( * ) Notice: Subject to any disclaimer, the term of this patent is extended or adjusted under 35 U.S.C. 154(b) by 0 days.

(21) Appl. No.: 15/865,499

(22) Filed: Jan. 9, 2018

(65) Prior Publication Data

US 2018/0128548 A1 May 10, 2018

Related U.S. Application Data

(63) Continuation of application No. PCT/CN2017/096379, filed on Aug. 8, 2017.

(30) Foreign Application Priority Data

Aug. 12, 2016 (CN) ..... 2016 2 0872698 U

(51) Int. Cl.
*F27D 1/18* (2006.01)
*F27D 99/00* (2010.01)

(52) U.S. Cl.
CPC ..... *F27D 1/1866* (2013.01); *F27D 1/18* (2013.01); *F27D 99/0073* (2013.01); *F27D 2099/0083* (2013.01)

(58) Field of Classification Search
CPC ..... F27D 2001/1825; F27D 2001/1875; F27D 2019/0084; F27D 1/1808; F27D 1/1866;
(Continued)

(56) References Cited

U.S. PATENT DOCUMENTS 5,224,999 A * 7/1993 Shiraiwa ..... C23C 16/4409 118/715
7,001,129 B2 * 2/2006 Kim ..... H01L 21/67126 414/217

(Continued)

FOREIGN PATENT DOCUMENTS

CN 103451740 A 12/2013
CN 104034160 A 9/2014

(Continued)

OTHER PUBLICATIONS

State Intellectual Property Office of the P.R. China (ISR/CN), "International Search Report for PCT/CN2017/096379", China, Nov. 10, 2017.

*Primary Examiner* — Gregory A Wilson
(74) *Attorney, Agent, or Firm* — Locke Lord LLP; Tim Tingkang Xia, Esq.

(57) ABSTRACT

A furnace door sealing device for a low-pressure diffusion furnace is provided. The furnace door sealing device includes a furnace door, a fixed shaft and a fixed base which are coaxially arranged in sequence from front to back. A bearing pedestal is fixed at the center of the rear end surface of the furnace door. A centripetal knuckle bearing is arranged in the bearing pedestal. An outer ring of the centripetal knuckle bearing is fixed in the bearing pedestal. An inner ring of the centripetal knuckle bearing fixedly sleeves the front end of the fixed shaft. The rear end of the fixed shaft is fixed in the fixed base. A supporting plate is also fixed on the front end surface of the fixed base. Multiple spring adjusting assemblies are arranged on the supporting plate at an interval.

10 Claims, 5 Drawing Sheets

(58) Field of Classification Search
CPC ..... F27D 99/0073; F27D 2099/0083; F27D 1/18; F27D 21/02; F27D 1/1858
See application file for complete search history.

(56) References Cited

U.S. PATENT DOCUMENTS

| | | | | |
|---|---|---|---|---|
| 7,351,057 | B2 * | 4/2008 | Berenbak | H01L 21/67126 432/242 |
| 9,803,926 | B2 * | 10/2017 | Kikuchi | F27B 17/0025 |
| 2003/0000476 | A1 * | 1/2003 | Matsunaga | C23C 16/54 118/719 |
| 2011/0240225 | A1 * | 10/2011 | Yamada | B65H 23/0322 156/390 |
| 2018/0216815 | A1 * | 8/2018 | Le Mer | F23D 91/04 |

FOREIGN PATENT DOCUMENTS

| | | | |
|---|---|---|---|
| CN | 106048731 | A | 10/2016 |
| CN | 205980793 | | 2/2017 |
| JP | 2011514960 | A | 5/2011 |

* cited by examiner

FURNACE DOOR SEALING DEVICE FOR LOW-PRESSURE DIFFUSION FURNACE

CROSS-REFERENCE TO RELATED PATENT APPLICATION

This application is a continuation application of International Patent Application No. PCT/CN2017/096379, filed on Aug. 8, 2017, which itself claims priority to Chinese Patent Application No. CN201620872698.0 filed in China on Aug. 12, 2016. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to a furnace door of a diffusion furnace, and in particular, to a furnace door sealing device for a low-pressure diffusion furnace.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In the photovoltaic industry, a high-temperature diffusion furnace is mainly used for doping a single crystal silicon wafer or a polycrystalline silicon wafer to form a PN junction. With the development of a diffusion process, the doping uniformity of the traditional high-temperature diffusion furnace cannot meet the technical requirements of the advanced battery process route, and a low-pressure diffusion furnace came into being. However, the low-pressure diffusion process needs to be carried out in a vacuum environment, and the sealing performance of a furnace door thereof directly affects the production quality.

In the prior art furnace door sealing devices, most of them are to fix a furnace door directly on a furnace door fixing base via screws. The position of the furnace door is adjusted mainly depending on adjusting screws. When the furnace door is adjusted by adjusting the screws on the furnace door fixing base, such adjustment way depending on screws is troublesome to operate, requires manual adjustment, and often requires multiple adjustments repeatedly, resulting in low production efficiency.

SUMMARY

In order to solve said technical problem, the present invention provides a furnace door sealing device for a low-pressure diffusion furnace. The furnace door sealing device has an automatic correction function and can achieve a favorable sealing effect easily just by slight adjustment.

The present invention adopts the following technical solution: a furnace door sealing device for a low-pressure diffusion furnace is designed, comprising a furnace door, a fixed shaft and a fixed base which are coaxially arranged in sequence from front to back, wherein a bearing pedestal is fixed at the center of the rear end surface of the furnace door; a centripetal knuckle bearing is arranged in the bearing pedestal; an outer ring of the centripetal knuckle bearing is fixed in the bearing pedestal; an inner ring of the centripetal knuckle bearing fixedly sleeves the front end of the fixed shaft; the rear end of the fixed shaft is fixed in the fixed base.

A supporting plate is also fixed on the front end surface of the fixed base. A plurality of spring adjusting assemblies are arranged on the supporting plate at an interval, wherein at least three of the spring adjusting assemblies are uniformly arranged with the axis of the furnace door as the center. Each spring adjusting assembly comprises an adjusting sleeve fixed on the supporting plate, an adjusting screw arranged in the adjusting sleeve, a pushing pillar with the rear end being arranged in the adjusting sleeve and the front end extending towards the furnace door, and a spring arranged in the adjusting sleeve, wherein two ends of the spring are compressed between the adjusting screw and the pushing pillar.

The pushing pillar is composed of a rear cylinder located in the adjusting sleeve and a front cylinder extending out of the adjusting sleeve. The diameter of the rear cylinder is larger than that of the front cylinder. The front end of the adjusting sleeve is provided with a telescopic hole which just allows the front cylinder to pass through movably.

Preferably, the inside wall of the rear end of the adjusting sleeve is provided with inner adjusting threads. The outside wall of the adjusting screw is provided with outer adjusting threads which are matched with the inner adjusting threads. The adjusting screw may be rotated to adjust a front-back position thereof in the adjusting sleeve.

Preferably, at least one anti-rotating pin is also fixed on the rear end surface of the furnace door, the supporting plate is provided with a limiting hole which has a diameter being larger than that of the anti-rotating pin, and the anti-rotating pin extends to the limiting hole.

Preferably, the supporting plate is provided with four spring adjusting assemblies, wherein two of the spring adjusting assemblies are located at two sides of the upper part of the furnace door, and the other two of the spring adjusting assemblies are linearly arranged in the middle of the lower part of the furnace door.

Preferably, three anti-rotating pins which are uniformly arranged with the axis of the furnace door as the center are fixed on the furnace door, wherein two of the anti-rotating pins are located at two sides of the lower part of the furnace door, and the other anti-rotating pin is located in the middle of the upper part of the furnace door.

Compared with the prior art, the furnace door sealing device disclosed by the present invention has the advantages that: the centripetal knuckle bearing is adopted a core component, the furnace door can obliquely swing to adjust the position under the action of the centripetal knuckle bearing, the spring is then adopted to restrain a universal space formed by the centripetal knuckle bearing, and the furnace door is pushed to obliquely swing so as to tightly be attached to a sealing flange at a port of a reaction chamber, such that the effects of automatically correcting the position and sealing the reaction chamber are achieved.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
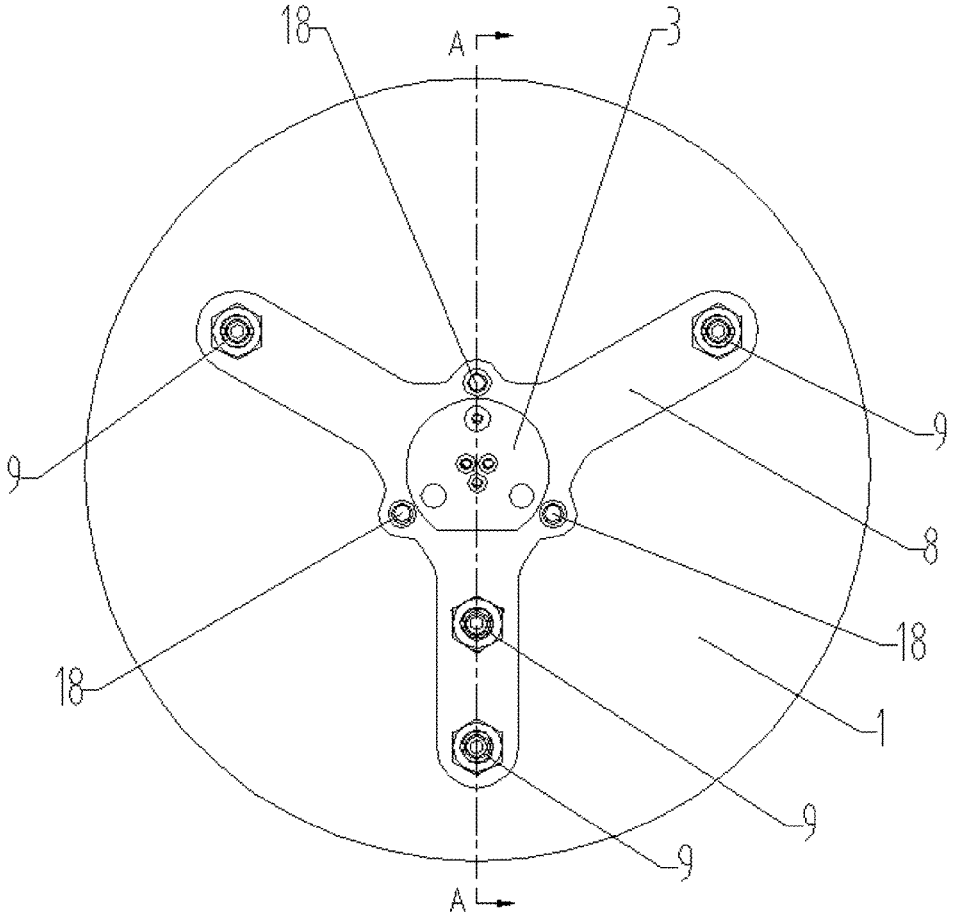
FIG. 1 is a schematic drawing of the back of the present invention.

The present disclosure will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

Figure 2:
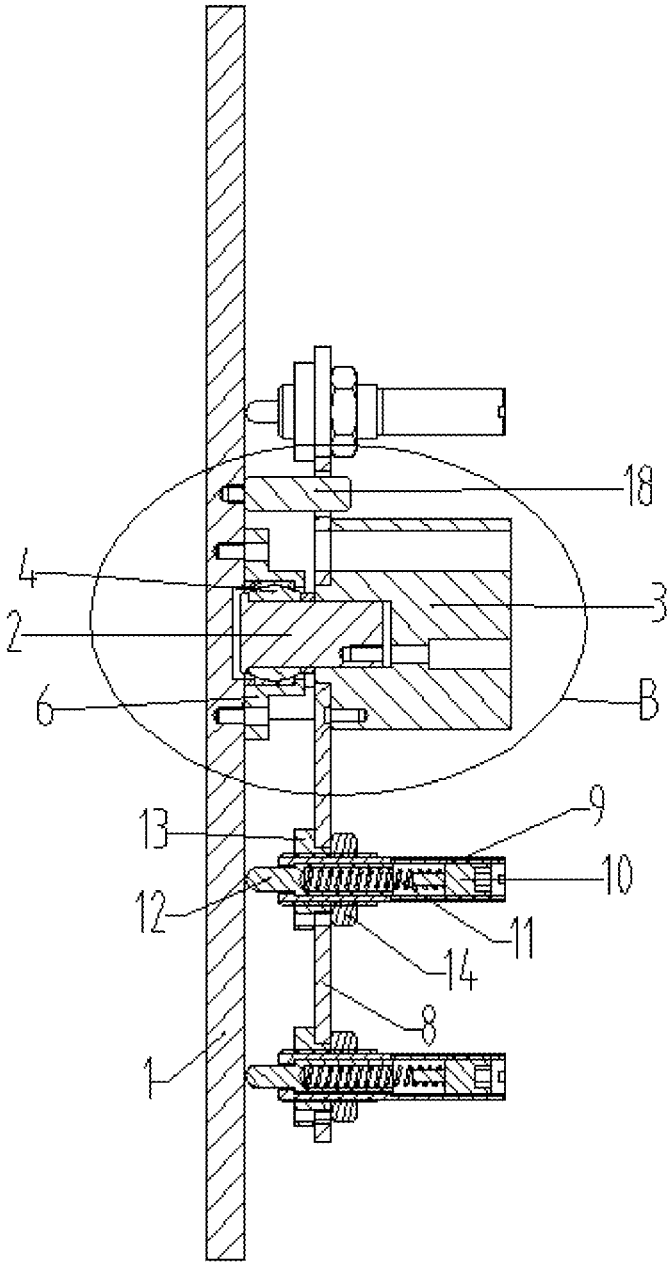
FIG. 2 is a sectional schematic drawing of A-A in FIG. 1.

As shown in FIGS. 1 and 2, a furnace door sealing device for a low-pressure diffusion furnace disclosed by the present invention comprises: a furnace door 1, a fixed shaft 2 and a fixed base 3 which are coaxially arranged in sequence from front to back, wherein the rear end of the fixed base 2 is fixed in the fixed base 3, and the front end of the fixed shaft 2 is connected to the rear end surface of the furnace door 1 via a centripetal knuckle bearing 4.

Figure 3:
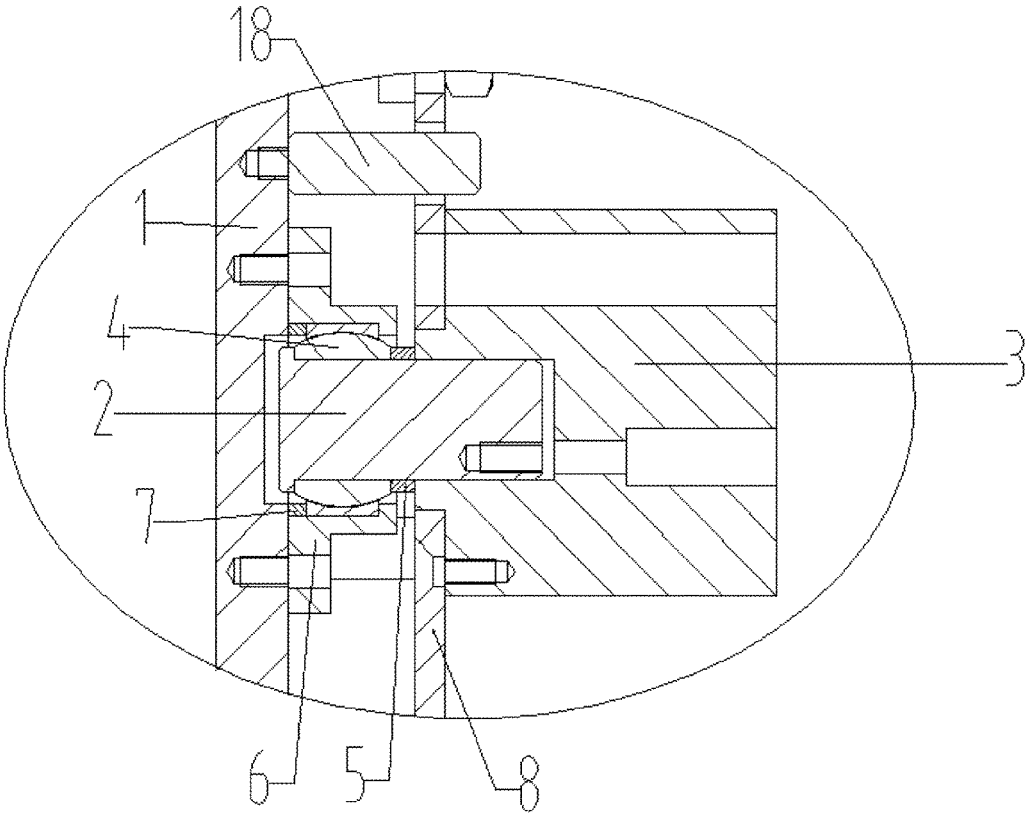
FIG. 3 is an enlarged schematic drawing of a part B in FIG. 2.

As shown in FIG. 3, the front end of the fixed shaft 2 is fixed in an inner ring of the centripetal knuckle bearing 4 and provided with a limiting ring which protrudes outwards. The fixed base 3 is further sleeved with a sleeve 5 which is located between the centripetal knuckle bearing 4 and the fixed base 3. The rear end of the fixed shaft 2 is provided with a threaded hole. The fixed base 3 is provided with a locking hole which is communicated to the threaded hole. The fixed shaft 2 is fixed to the fixed base 3 via a screw. The inner ring of the centripetal knuckle bearing 4 is clamped between the limiting ring and the sleeve 5 after the screw is locked, thereby realizing the fixed connection between the inner ring of the centripetal knuckle bearing and the fixed shaft 2.

A bearing pedestal 6 is fixed at the center of the rear end surface of the furnace door 1. The front end of the bearing pedestal 6 is open. The centripetal knuckle bearing 4 located in the bearing pedestal 6. A washer 7 is also arranged between the outer ring of the centripetal knuckle bearing 4 and the rear end surface of the furnace door 1. The rear end of the bearing pedestal 6 is provided with a through hole which has a size just to limit the outer ring of the centripetal knuckle bearing 4 within the bearing pedestal 6. After the bearing pedestal 6 and the furnace door 1 are fixed, the outer ring of the centripetal knuckle bearing 4 is clamped between the washer 7 and the bearing pedestal, thereby realizing the fixed connection between the outer ring of the centripetal knuckle bearing and the furnace door 1.

Figure 4:
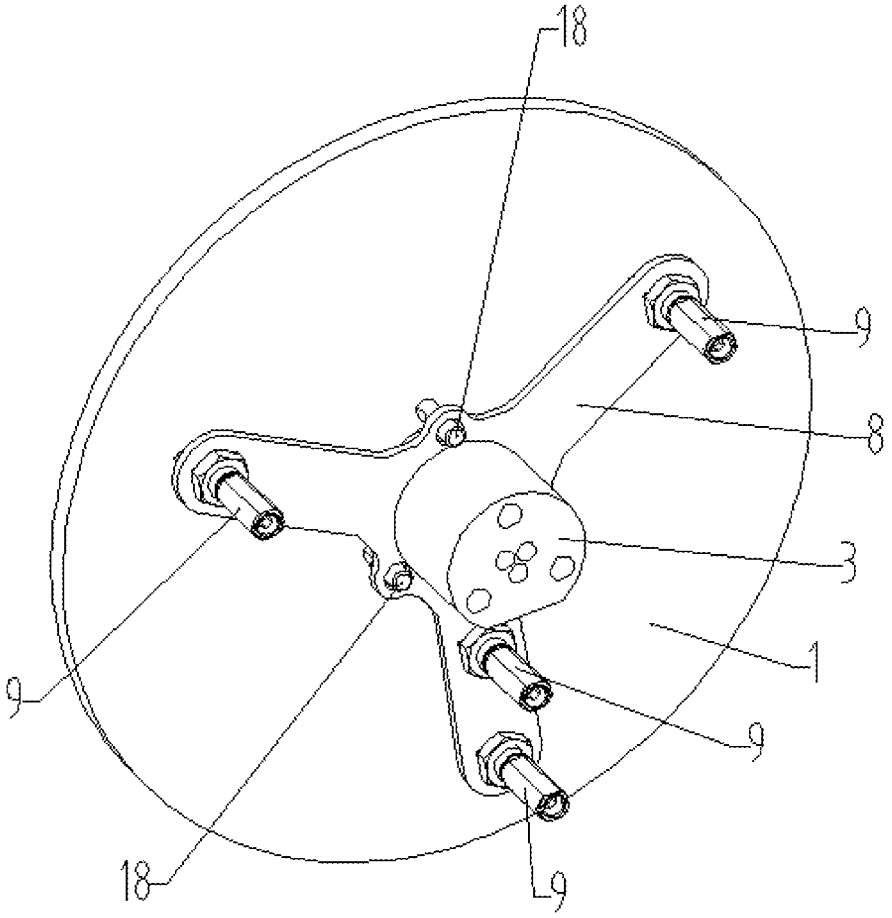
FIG. 4 is a three-dimensional schematic drawing of the present invention.

As shown in FIGS. 1, 2 and 4, a supporting plate 8 is also fixed on the front end surface of the fixed base 3. A plurality of spring adjusting assemblies are arranged on the supporting plate 8 at an interval, wherein at least three of the spring adjusting assemblies are uniformly arranged with the axis of the furnace door 1 as the center. Each spring adjusting assembly comprises an adjusting sleeve 9, an adjusting screw 10, a spring 11 and a pushing pillar 12.

The adjusting sleeve 9 is fixed on the supporting plate 8. The supporting plate 8 is provided with a mounting hole which allows the adjusting sleeve 9 to pass through. The adjusting sleeve 9 is fixed on the supporting plate 8 through a nut base 13 and a nut 14. The outside wall of the front end of the adjusting sleeve 9 is provided with outer fixing threads. The nut base 13 and the nut 14 sleeve the outer fixing threads respectively. The supporting plate 8 is clamped between the nut base 13 and the nut 14, thereby realizing the fixed connection between the adjusting sleeve 9 and the supporting plate 8. The adjusting screw 10 is connected into the rear end of the adjusting sleeve 9. The pushing pillar 12 is composed of a front cylinder and a rear cylinder having a diameter being larger than that of the front cylinder, wherein the rear cylinder is located in the adjusting sleeve 9, and the front cylinder is located outside the adjusting sleeve 9 and extends towards the furnace door 1. The front end of the adjusting sleeve 9 is provided with a telescopic hole which just allows the front cylinder to pass through movably. Two ends of the spring 11 are compressed between the adjusting screw 10 and the pushing pillar 12. Since the spring 11 is in a compressed state, it is possible to ensure that the pushing pillar 12 always has a thrust to push the furnace door 1 forwards.

Figure 5:
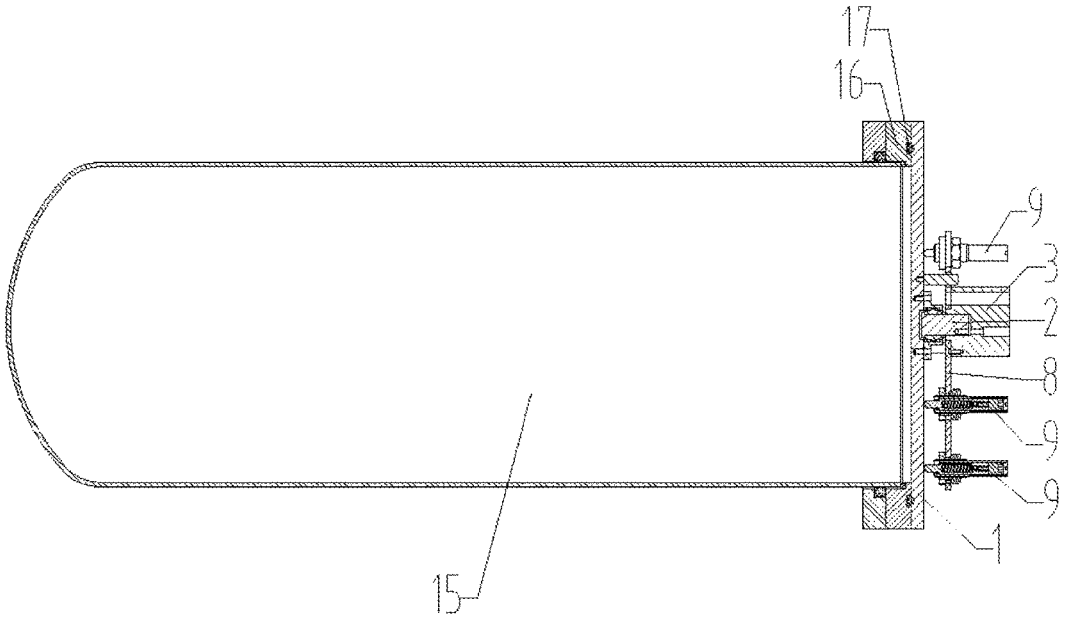
FIG. 5 is a sectional schematic drawing when the furnace door sealing device of the present invention is sealed at a port of a reaction chamber.

As shown in FIG. 5, in actual installation and use, a driving mechanism is also connected to the rear end of the fixed base 3 and drives the furnace door sealing device to move towards a reaction chamber 15. A sealing flange 16 is arranged at a port of the reaction chamber 15 in a sealing manner. A sealing ring 17 which protrudes outwards is arranged on the end surface of the sealing flange 16. The furnace door 1 moves till it is completely attached to the sealing flange 16 to extrude the sealing ring 17, thereby completing the sealing of the reaction chamber 15. Since the centripetal knuckle bearing 4 is a spherical slide bearing whose sliding contact surfaces are an inner spherical surface and a spherical outer surface, it is possible to rotate and swing at any angle while moving. The centripetal knuckle bearing 4 can obliquely swing after being mounted to be attached to the surface of the sealing flange 16, so as to automatically adapt to the sealing flange 16 and the sealing ring 17, and therefore, the position adjusting effect is favorable. Meanwhile, when the furnace door 1 rotates and swings, since a plurality of pushing pillars 12 always have a thrust to push the furnace door 1 forwards, it is possible to ensure that the furnace door 1 can be tightly pressed on the surface of the sealing ring 17 while adapting to the sealing flange 16 and the sealing ring 17, and therefore, the sealing performance is better.

Preferably, as shown in FIGS. 1 and 4, the supporting plate 8 is provided with four spring adjusting assemblies, wherein two of the spring adjusting assemblies are located at two sides of the upper part of the furnace door 1, and the other two spring adjusting assemblies are linearly arranged in the middle of the lower part of the furnace door 1. This is due to the presence of gravity in the furnace door 1, and under the action of gravity, the furnace door 1 will swing downwards, that is, the top is inclined forwards and the bottom is inclined backwards. Two spring adjusting assemblies may be arranged in the middle of the lower part of the furnace door 1 to keep the furnace door 1 upright, and after the furnace door 1 is attached to the sealing flange 16, each position is stressed uniformly.

More preferably, as shown in FIG. 2, the inside wall of the rear end of the adjusting sleeve 9 is provided with inner adjusting threads, and the outside wall of the adjusting screw 10 is provided with outer adjusting threads which are matched with the inner adjusting threads. The adjusting screw 10 may be rotated to move forwards and backwards in the adjusting sleeve 9 to change a compressed state of the spring 11, thereby adjusting the thrust of the pushing pillars 12 on the furnace door 1.

Further, as shown in FIGS. 2 and 3, in order to prevent the furnace door 1 from rotating by 360 degrees with the centripetal knuckle bearing 4 as the center, at least one anti-rotating pin 18 is also fixed to the rear end surface of the furnace door 1. The supporting plate 8 is provided with a limiting hole having a diameter being larger than that of the anti-rotating pin 18, and the anti-rotating pin 18 extends into the limiting hole, which will not affect the rotation and swing of the furnace door 1 within a certain range, and also limit the 360-degree rotation of the furnace door 1. In the present embodiment, as shown in FIGS. 1 and 4, three anti-rotating pins 18 which are uniformly arranged with the axis of the furnace door 1 as the center are fixed on the furnace door 1, wherein two of the anti-rotating pins 18 are located at two sides of the lower part of the furnace door, and the other anti-rotating pin 18 is located in the middle of the upper part of the furnace door 1.

The above detailed description only describes preferable embodiments of the present invention, and is not intended to limit the patent scope of the present invention, so any equivalent technical changes made by use of the specification of the creation and the content shown in the drawings fall within the patent scope of the creation.

What is claimed is:

1. A furnace door sealing device for a low-pressure diffusion furnace, comprising a furnace door (1), a fixed shaft (2) and a fixed base (3) which are coaxially arranged in sequence from front to back, wherein a bearing pedestal (6) is fixed at the center of the rear end surface of the furnace door (1); a centripetal knuckle bearing (4) is arranged in the bearing pedestal (6); an outer ring of the centripetal knuckle bearing (4) is fixed in the bearing pedestal (6); an inner ring of the centripetal knuckle bearing (4) fixedly sleeves the front end of the fixed shaft (2); the rear end of the fixed shaft (2) is fixed in the fixed base (3);

a supporting plate (8) is also fixed on the front end surface of the fixed base (3); a plurality of spring adjusting assemblies are arranged on the supporting plate (8) at an interval, and at least three spring adjusting assemblies are uniformly arranged with the axis of the furnace door (1) as the center;

each spring adjusting assembly comprises an adjusting sleeve (9) fixed on the supporting plate (8), an adjusting screw (10) arranged in the adjusting sleeve (9), a pushing pillar (12) with the rear end being arranged in the adjusting sleeve (9) and the front end extending towards the furnace door (1), and a spring (11) arranged in the adjusting sleeve (9), wherein two ends of the spring (11) are compressed between the adjusting screw (10) and the pushing pillar (12).

2. The furnace door sealing device for the low-pressure diffusion furnace according to claim 1, wherein the pushing pillar (12) is composed of a rear cylinder located in the adjusting sleeve (9) and a front cylinder extending out of the adjusting sleeve (9); the diameter of the rear cylinder is larger than that of the front cylinder; the front end of the adjusting sleeve (9) is provided with a telescopic hole which just allows the front cylinder to pass through movably.

3. The furnace door sealing device for the low-pressure diffusion furnace according to claim 2, wherein the inside wall of the rear end of the adjusting sleeve (9) is provided with inner adjusting threads; the outside wall of the adjusting screw (10) is provided with outer adjusting threads which are matched with the inner adjusting threads; the adjusting screw (10) may be rotated to adjust a front-back position thereof in the adjusting sleeve (9).

4. The furnace door sealing device for the low-pressure diffusion furnace according to claim 3, wherein at least one anti-rotating pin (18) is also fixed on the rear end surface of the furnace door (1), the supporting plate (8) is provided with a limiting hole which has a diameter being larger than that of the anti-rotating pin (18), and the anti-rotating pin (18) extends to the limiting hole.

5. The furnace door sealing device for the low-pressure diffusion furnace according to claim 4, wherein the supporting plate (8) is provided with four spring adjusting assemblies, wherein two of the spring adjusting assemblies are located at two sides of the upper part of the furnace door (1), and the other two of the spring adjusting assemblies are linearly arranged in the middle of the lower part of the furnace door (1).

6. The furnace door sealing device for the low-pressure diffusion furnace according to claim 2, wherein at least one anti-rotating pin (18) is also fixed on the rear end surface of the furnace door (1), the supporting plate (8) is provided with a limiting hole which has a diameter being larger than that of the anti-rotating pin (18), and the anti-rotating pin (18) extends to the limiting hole.

7. The furnace door sealing device for the low-pressure diffusion furnace according to claim 6, wherein the supporting plate (8) is provided with four spring adjusting assemblies, wherein two of the spring adjusting assemblies are located at two sides of the upper part of the furnace door (1), and the other two of the spring adjusting assemblies are linearly arranged in the middle of the lower part of the furnace door (1).

8. The furnace door sealing device for the low-pressure diffusion furnace according to claim 1, wherein at least one anti-rotating pin (18) is also fixed on the rear end surface of the furnace door (1), the supporting plate (8) is provided with a limiting hole which has a diameter being larger than that of the anti-rotating pin (18), and the anti-rotating pin (18) extends to the limiting hole.

9. The furnace door sealing device for the low-pressure diffusion furnace according to claim 8, wherein the supporting plate (8) is provided with four spring adjusting assemblies, wherein two of the spring adjusting assemblies are located at two sides of the upper part of the furnace door (1), and the other two of the spring adjusting assemblies are linearly arranged in the middle of the lower part of the furnace door (1).

10. The furnace door sealing device for the low-pressure diffusion furnace according to claim 9, wherein three anti-rotating pins (18) which are uniformly arranged with the axis of the furnace door (1) as the center are fixed on the furnace door (1), wherein two of the anti-rotating pins (18) are located at two sides of the lower part of the furnace door (1), and the other anti-rotating pin (18) is located in the middle of the upper part of the furnace door (1).

* * * * *